United States Patent [19]

Jackson, Jr.

[11] Patent Number: 4,986,037

[45] Date of Patent: Jan. 22, 1991

[54] COLLAPSIBLE SHED FOR VEHICLES AND OTHER OBJECTS

[76] Inventor: Payton Jackson, Jr., 20358 Berg St., Detroit, Mich. 48219

[21] Appl. No.: 463,501

[22] Filed: Jan. 11, 1990

[51] Int. Cl.[5] ..... E04B 1/346

[52] U.S. Cl. ..... 52/67; 52/143; 52/64; 160/23.1; 160/290.1

[58] Field of Search ..... 52/67, 143, 64, 66; 160/23.1, 290.1, 271, 273.1; 280/638

[56] References Cited

U.S. PATENT DOCUMENTS

| | | | |
|---|---|---|---|
| 1,202,559 | 10/1916 | Mercer | 160/273.1 |
| 2,580,776 | 1/1952 | Herman | 160/23.1 |
| 2,769,491 | 11/1956 | Pitcoff | 160/23.1 |
| 3,116,097 | 12/1963 | Novales | 160/271 X |
| 3,146,824 | 9/1964 | Veilleux | 160/23.1 |
| 3,665,997 | 5/1972 | Smith et al. | 160/23.1 X |
| 3,719,386 | 3/1973 | Puckett et al. | 52/67 X |
| 4,191,433 | 3/1980 | Rampp et al. | 52/67 X |
| 4,288,949 | 9/1981 | Latimer | 52/67 |
| 4,577,562 | 3/1986 | Berman | 52/67 X |
| 4,711,257 | 12/1987 | Kobayashi | 52/67 X |
| 4,807,687 | 2/1989 | Finch et al. | 160/271 X |

FOREIGN PATENT DOCUMENTS

| | | | |
|---|---|---|---|
| 2321969 | 11/1973 | Fed. Rep. of Germany | 160/271 |
| 1020785 | 2/1966 | United Kingdom | 160/273.1 |
| 1175772 | 12/1969 | United Kingdom | 160/273.1 |
| 2026057 | 1/1980 | United Kingdom | 52/67 |

*Primary Examiner*—Henry E. Raduazo
*Assistant Examiner*—Lan Mai
*Attorney, Agent, or Firm*—Dykema Gossett

[57] ABSTRACT

A collapsible shed for a vehicle and other objects includes a fixed enclosure anchored to the ground surface having an open front and a telescoping enclosure of inverted U-shape guidably mounted upon the fixed enclosure and at one end movably supported upon the ground surface, to overly the fixed enclosure when collapsed and retractable for an increased storage area. The telescoping enclosure is closed by retractable roller curtain that can be locked down with the movable enclosure in any position.

8 Claims, 3 Drawing Sheets

COLLAPSIBLE SHED FOR VEHICLES AND OTHER OBJECTS

FIELD OF THE INVENTION

The invention relates to sheds and more particularly to a collapsible shed for vehicles and other objects.

BACKGROUND OF THE INVENTION

Sheds of various constructions are previously known and are available on the market in all sizes and shapes simulating buildings and normally of a fixed size and volumetric content. Sheds have been used for a number of useful articles such as power lawn mowers, garden equipment, hoses, bicycles, strollers and the like including motorcycles but apparently are not normally used for the storage of vehicles except possibly for the construction of a small garage which serves as an enclosure for vehicles.

SUMMARY OF THE INVENTION

An important feature of the present invention is to provide a collapsible shed which when collapsed, has a usable volume adapted for the storage of bicycles or motorcycles or other objects less than a vehicle but which has a retractable overlying housing mounted over the stationary housing such that when retracted there is provided an increased volumetric capacity such as will receive a complete vehicle for storage therein.

Another feature is to provide as a part of the collapsible shed series of side walls, top wall and rear wall together with a flange means for anchoring the stationary enclosure to the ground surface or a concrete slab for illustration.

Another feature includes the guided support mounting of the movable or collapsible enclosure upon and over the stationary enclosure such that upon retraction of the movable enclosure relative to the stationary enclosure there will be a combined storage area within both sufficient to receive and protectively store and enclose a vehicle and particularly compact vehicles, though not limited thereto.

As another feature, the stationary enclosure has an open end whereas the retractable enclosure is open at both ends but includes at its outer end a collapsible closure, shade, curtain or door such that with normal use the closure may be raised to permit access to the interior of the extended collapsible shed and may be manually closed and locked for the security of objects including a vehicle stored within such collapsible shed.

As another feature, there is provided upon the stationary closure a pair of opposed guide rails or channels. Upon the interior of the movable enclosure are a pair of opposed support rollers which are positioned within, guidably mounted and supported upon said channels.

An additional pair of opposed rollers are journaled upon a forward interior end portion of the movable enclosure adapted for engagement with the ground surface to facilitate retraction of the movable enclosure over and onto the stationary enclosure. With the curtain or shade or other closure in its down position the reduced size shed may be useful for the storage of various objects.

It is another feature whereby the respective rollers function to supportably mount the retractable telescoping enclosure to its outermost position for an increased volume of the shed adapted to receive an elongated object such as a vehicle, a canoe or boat, or the like and wherein a closure is provided upon the telescoping member which may be locked to protectively enclose objects within the collapsible shed.

An important feature is to provide a closure or roller shade upon the outer movable enclosure such that it may be rolled up upon a spring biased roller for opening the outer end of the movable enclosure and which may be lowered to a closure position and locked as desired.

Another feature is to provide a modified embodiment wherein a first pair of guide rollers are mounted upon the exterior of the stationary enclosure at its forward lower end adapted to be received within a pair of opposed interior elongated channels mounted upon the inner surfaces of the collapsible enclosure movably positioned over and receiving the first pair of rollers. There is also provided a second pair of opposed rollers upon the interior of the collapsible enclosure at its lower edge adapted for engagement with the ground surface to facilitate adjustment movements of the telescoping enclosure towards and away from the stationary enclosure.

These and other objects and features will be seen from the following specification and claims in conjunction with the appended drawings.

THE DRAWINGS

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Figure 1:
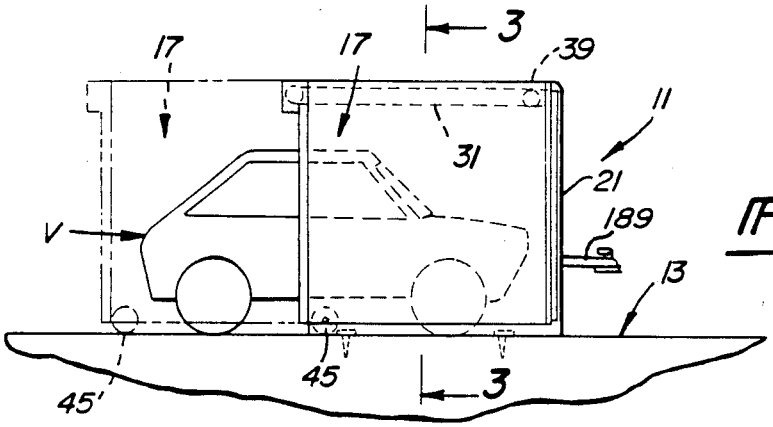
FIG. 1 is a fragmentary side elevational view of the present collapsible shed in a collapsed condition and showing the collapsible shed fully opened by phantom lines for the enclosure of a vehicle.
Figure 3:
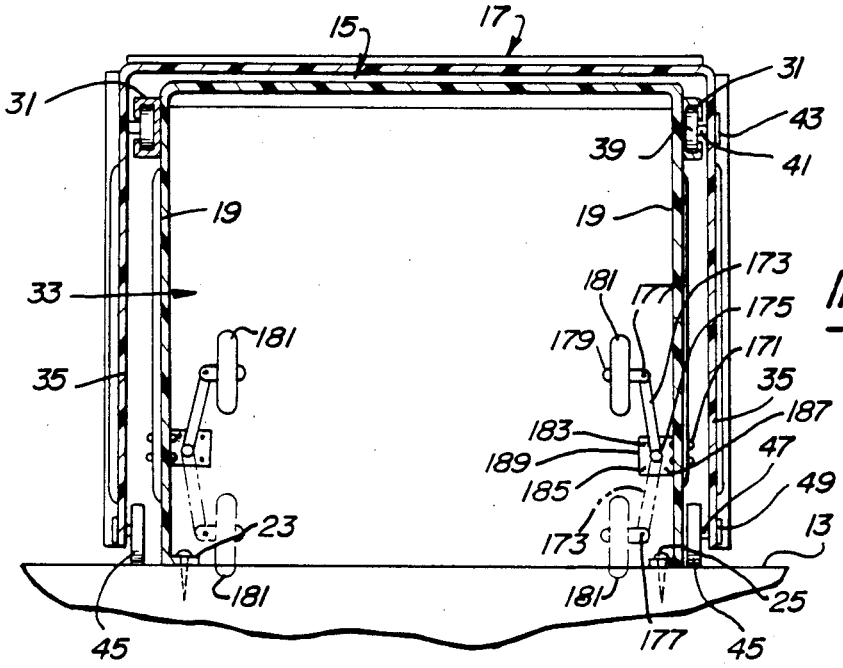
FIG. 3 is a section taken in the direction of arrows 3—3 of FIG. 1, and on an increased scale.
Figure 4:
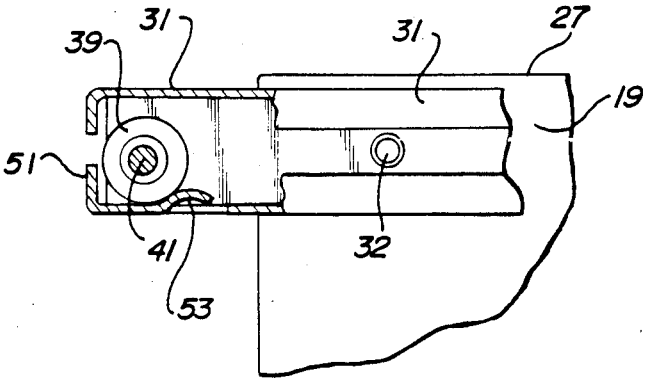
FIG. 4 is a fragmentary section taken in the direction of arrows 4—4 of FIG. 2.
Figures 2, 5:
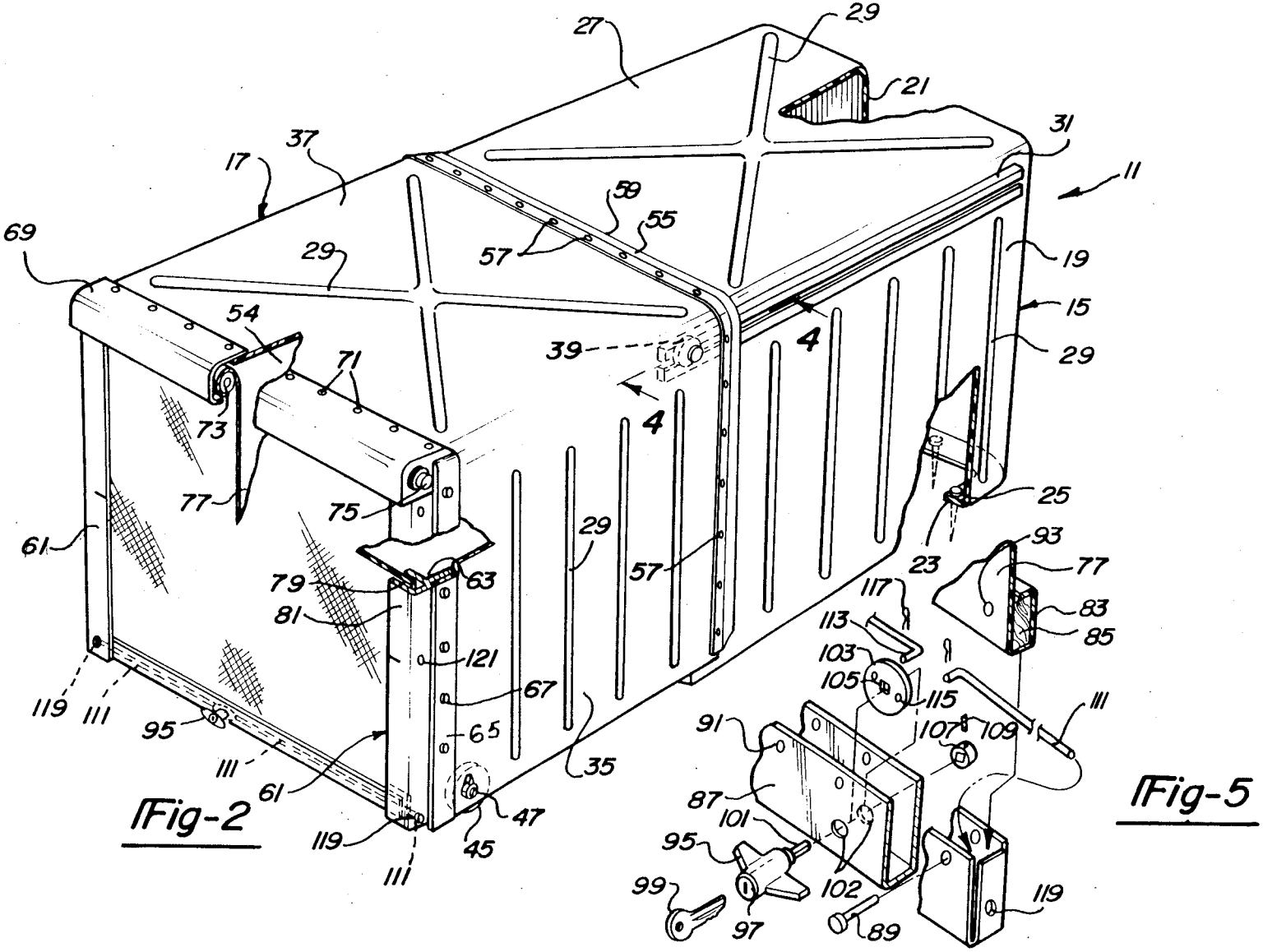
FIG. 2 is a front perspective view of the enclosure shown in FIG. 1, fully open and on an increased scale with portions broken away and sectioned for illustration.
FIG. 5 is an exploded perspective view of the lock assembly and handle for the curtain fragmentarily shown in FIG. 2, and on an increased scale for clarity.

Referring to the drawings, FIGS. 1–5, the present collapsible shed is generally indicated at 11, FIGS. 1–2 as mounted upon a concrete slab 13, fragmentarily shown or which could be the ground surface adjacent a home or other building. The present collapsible shed includes a fixed enclosure 15 of general inverted U-shape open at the front and a telescoping or movable enclosure 17 of inverted U-shape, open at its opposite ends. In its collapsed position it is mounted over the fixed enclosure as shown in FIG. 1.

The present fixed enclosure includes a pair of opposed side walls 19 and rear wall 21. Both side walls and rear wall terminate in an inwardly directed mount flange 23 or a series of tabs 23 which are apertured and are adapted to receive fasteners 25. Such fasteners may be screws or spikes which extend into the slab 13 or into open holes cut into such slab in a conventional manner.

The fixed enclosure includes top wall 27, with all of said walls in the preferred embodiment being of a reinforced Fiberglas TM to provide suitable stiffness and be self-standing. In the illustrative embodiment, the respective side walls and top walls include the stiffening corrugations 29.

A pair of opposed roller guide support channels 31 are mounted upon upper portions of the opposed side walls 19, FIG. 2, and secured thereon by a plurality of fasteners 32, FIG. 4.

The fixed enclosure 15 defines a first storage area 33, FIG. 3 which may have considerable utility even when the telescoping enclosure 17 is in its retracted position such as shown in FIG. 1. In such position, the single storage area 33 is sufficient for the storage of smaller articles such as lawn mowers, power mowers, bicycles, or other lawn equipment.

The present retractable or telescoping enclosure 17 includes a pair of opposed side walls 35 similarly corrugated at 29 for increased stiffness, and a top wall 37 likewise corrugated at 29. Said enclosure is generally of inverted U-shape with both ends open. In the illustrative embodiment, a first pair of rollers 39, sometimes referred to as rear rollers are mounted upon the interior of the respective side walls 35 of the movable enclosure upon corresponding axles 41, FIG. 3, anchored to such walls as at 43.

A second pair of rollers or wheels 45 are journaled upon corresponding axles 47 anchored at 49 within the forward ends of the corresponding side walls 35 and engagable with the ground surface or slab 13. This facilitates retracting and collapsing movements of the movable enclosure 17 with respect to the stationary or fixed enclosure 15. The opposed pair of rollers 39 are movably positioned within an ride upon and along the corresponding support channels 31, FIG. 2. In the detail illustrating the rollers 39 mounted within the corresponding channels 31, there is provided at the forward ends of the respective channels the stop flanges 51, thereby limiting outward movements of the movable enclosure 17 with respect to the stationary enclosure 15.

Upon the forward ends of each of the roller support channels 31 and rearwardly of the corresponding flanges 51 are a pair of arcuate detents or stops 53 which are normally arranged rearwardly of the rollers 39 when the movable enclosure has been moved to its outermost position, FIG. 4. The advantage of the detents is that the extended enclosure will not accidentally or by the wind move inwardly until some small additional force is applied such as would move the rollers 39 so as to ride over the yieldable detents 53 forming a part of the corresponding channels 31.

The movable or telescoping enclosure 17 is in its outermost position as shown in dash lines, FIG. 1, and in solid lines, FIG. 2. A vehicle V may be stored within the increased volumetric capacity provided by storage area 33 of the stationary enclosure and the additional storage area 54 of the telescoping enclosure. Mounted over the trailing or rear end portion of the movable enclosure 17 is an elongated trim seal or sheath 55 which is secured along rear edge portions of the corresponding side and top walls 35–37 of the movable enclosure as by fasteners 57. The trim seal terminates in a rearwardly extending flexible flap 59 which sealing engages over adjacent surface portions of the corresponding side walls and top wall 19 and 27 of the fixed enclosure 15. This establishes a good seal between both enclosures and particularly when the movable enclosure has been moved outwardly to the position shown in FIG. 2.

Adjacent the forward end of the movable enclosure 17 are a pair of upright laterally spaced channel posts 61 which include a mount flange 63, fragmentarily shown in FIG. 2. Corresponding side walls 35 of the movable enclosure include upright end flanges 65 which overlie mount flange 63 and are secured thereto by a plurality of fasteners 67. Elongated transverse roller and shade housing or cowling 69 overlies the outer end of the movable enclosure 17 throughout its width and is secured to the top wall 37 by a plurality of fasteners 71. Elongated roller 73, preferably a spring biased roller, is journaled at is ends as at 75 upon end portions of the roller housing 69.

A suitable curtain or retractable closure 77 is anchored to and wound around the roller 73. Opposite edge portions 79 of the curtain or closure 77 nest within the corresponding opposed channels 81 forming a part of channel post 61.

As schematically shown in FIG. 5, an elongated loop 83 is formed at the lower end of the curtain or closure 77. Said loop receives the elongated anchor or stiffener 85, similar to the construction of a conventional flexible shade in the building. The stiffener 85 and the surrounding adjacent loop portion 83 normally nests within the elongated U-shaped channel 87, fragmentarily shown, and is secured thereto by a series of longitudinally spaced fasteners 89. These extend through a plurality of longitudinally spaced apertures 91 in said channel and through corresponding apertures 93 in the curtain and stiffener 85.

Intermediate the ends of the closure 77 at its lower end is a handle or handle lock 95 shown in a locking position in FIG. 2 and 5. The handle lock includes a conventional cylinder lock 97 and key 99. The cylinder lock includes a shank 101 of square cross-section which extends through apertures 102 in channel 87 and into a corresponding square opening 105 within the control disc 103. The control disc is positioned upon the interior of the channel 87 below the stiffener 85 and is retained thereon by the lock nut 107 including the fastener 109.

A pair of elongated aligned lock bars 111 are nested within the channel 87 with their angular inner ends 113 nested within opposed apertures 115 in the disc 103 and retained thereon by the pair of cotter pins 117 shown in the exploded view, FIG. 5.

The outer end portions of the corresponding outwardly directed lock bars 111 are adapted to project through lock bar apertures 119 within end portions of the corresponding channels 81 for securing the closure in its lowermost position, FIG. 2 or possibly in an intermediate position utilizing the lock bar apertures 121.

With the handle lock 95 shown in the horizontally extended position, FIGS. 2 and 5, the apertures 115 are at their maximum distance laterally with respect to the center of the lock shank 101. This retains the lock bars 111 in a locking position as in FIG. 2. By rotating the lock 90 degrees from the position shown in FIG. 5, the disc 103 is rotated 90 degrees causing such sufficient retraction of the lock bars 111 as to disengage from the channels 81 to permit authorized lifting of the closure or shade 77 or to permit its spring-biased retraction to an uppermost open position.

In the illustrative embodiment, there has been provided a suitable lock cylinder 97 and key 99 by which the handle lock 95 may be secured in the locked condition shown in FIGS. 2 and 5. Alternately, the lock portion could be omitted if it is merely desired that the closure be anchored in its lowermost position, in the event that the spring bias upon the roller is such that otherwise the roller shade or closure would advance upwardly unless so retained.

The conventional type of detents normally found on spring-biased shades could be employed in the place of the lock bars so that the curtain closure 77 would remain in the lowermost closed position without locking, if desired or any other elevated position intermediate fully closed and fully open.

Modified Collapsible Shed

Referring to FIGS. 6–10 there is shown a modified collapsible shed 125. The collapsible shed includes fixed enclosure 127 having downwardly and outwardly curved side walls 129, a downwardly and rearwardly curved top wall 131 merging with a downwardly and rearwardly curved rear wall 133. Upon the lower edges of the side walls 129 and rear wall 133 there is provided a marginal hold down flange 135, FIGS. 8 and 9 employing suitable fasteners or spikes 137 for anchoring the stationary enclosure to the ground surface or to a slab 13 such as above-described with respect to FIGS. 1-5. The stationary enclosure 127 has an open front 139 and mounted thereover there is provided a telescoping enclosure 141 of general inverted U-shape. The telescoping or movable enclosure includes a pair of downwardly and outwardly curved side walls 143, top wall 145 and a pair of laterally spaced opposed front panels 147. The telescoping enclosure is normally open at its opposite ends and includes at its forward end a retractable closure or shade 77 similar to the construction described with respect to FIG. 2.

In this embodiment of the collapsible shed there are arranged upon forward ends of the side walls 129 of the fixed enclosure 129 at its lower edges a pair of outwardly directed guide rollers 149 sometimes referred to as a first pair of rollers. These have suitable axles 151 secured to the corresponding side walls 129 or anchored thereon as at 153, FIG. 7.

A pair of opposed elongated guide support channels 155 are mounted upon the interior of corresponding side walls 143 adjacent their lower edges and are adapted to be cooperatively received over the corresponding first guide rollers 149.

Figure 6:
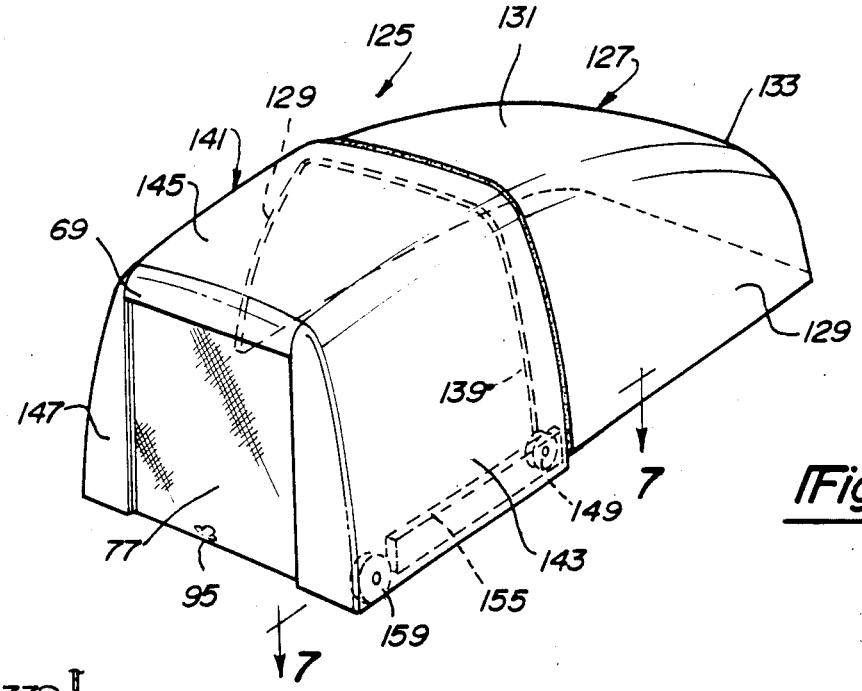
FIG. 6 is a front perspective view of a modified collapsible shed.
Figure 7:
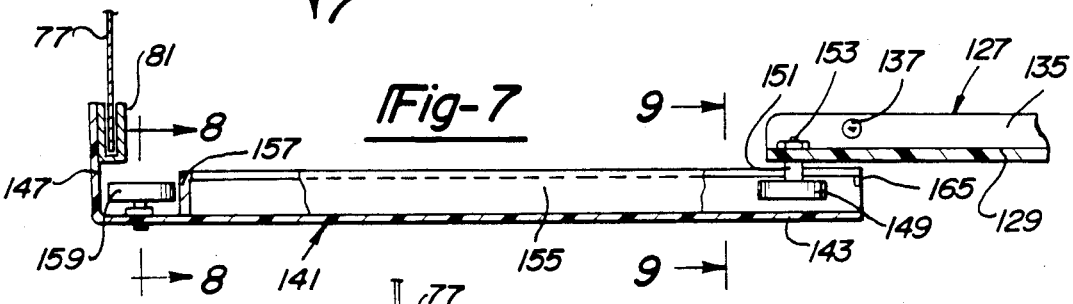
FIG. 7 is a fragmentary section taken in the direction of arrows 7—7 of FIG. 6, and upon an increased scale.
Figure 10:
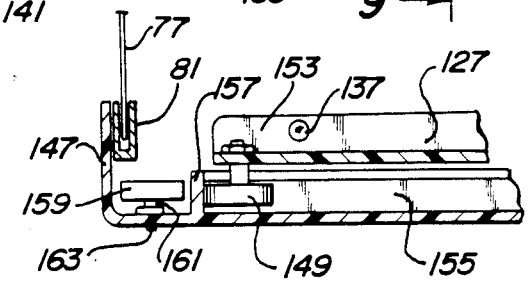
FIG. 10 is a section corresponding to FIG. 7 but with the movable enclosure collapsed relative to the stationary enclosure shown in FIG. 6.
Figure 8:
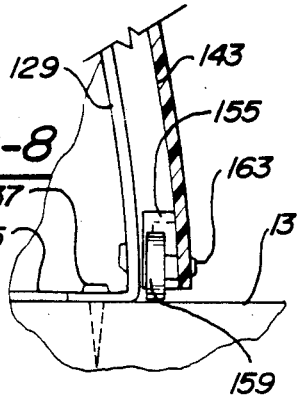
FIG. 8 is a fragmentary section taken in the direction of arrows 8—8 of FIG. 7.
Figure 9:
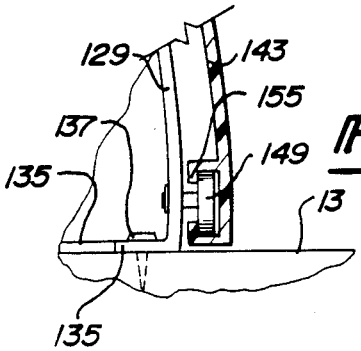
FIG. 9 is a fragmentary section taken in the direction of arrows 9—9 of FIG. 7.

The respective channels 143 at their forward ends terminate in the out-turned stops 157, FIGS. 7 and 10, limiting collapsing inward movement of the movable enclosure relative to the stationary enclosure. The respective stops 157 are in operative engagement with the guide rollers 149. A second pair of rollers or front wheels 159 are mounted upon the interior of the side walls 143 of the collapsible enclosure at their forward ends and are adaptive for operative engagement with the ground surface 13 as in FIGS. 6 and 8.

Thus, the forward end portions of the movable enclosure 145 ride along the slab 13 with the adjacent channel supports 155 upon the side walls of the movable enclosure supportably bearing upon the first pair of rollers 149 on the stationary enclosure. This guides the longitudinal movements of the movable housing 141 from a position shown in FIG. 6 to a collapsed position, if desired.

In FIG. 6, the corresponding closure or shade 77 which corresponds to the closure shown at 77, in FIG. 2, may be in its closed position or locked in such position to protectively enclose whatever is stored within the collapsible shed such as the vehicle V shown in FIG. 1, for illustration. The shed may be used for other purposes such as for the storage of a boat or a canoe or the like, with protection against the weather or the climate and against theft or vandalism.

A pair of stops 165 may be arranged upon the forward ends of the respective channels 143, FIG. 7, in order to limit outward movements of the movable closure 145 such as to the position shown in FIG. 6 with the stops 165 engaging the corresponding rollers 149.

Referring to FIG. 3, mounted upon the interior of side walls 19 adjacent the open end of the enclosure there are provided a pair of inwardly directed brackets 169 anchored thereto by fasteners 171. On each bracket there is pivotally mounted at 175 an elongated arm 173 at its free end pivotally connected at 177 to an axle 179 for an auxiliary wheel 181. The auxiliary wheel in FIG. 3 is shown in an elevated, retracted, non-use position and is held elevated by the transverse detent or detent bolt 183. On removal of the detent 183, the arm 173 may be swung to a lowermost position through an arc of 180 degrees as shown in dashed lines as a fixed enclosure partly elevated above the ground surface and held in position by the detent bolt 185. This provides a means by which the collapsible shed is transportable as desired over the ground surface or over a road or street. For this purpose, as shown in FIG. 1, there is secured centrally of the rear wall 21 a rearwardly extending trailer hitch 189.

Having described my invention, reference should now be made to the following claims:

I claim:

1. A collapsible shed for a vehicle and other objects comprising:

a fixed enclosure anchored to the ground surface and having an open front;

a telescoping enclosure of inverted U-shape having top and side walls with trailing edges, front and rear ends overlying and guidably mounted and supported at its rear end upon the fixed enclosure and at the front end movably supported upon the group surface, and adapted to retract from the fixed enclosure, with the combined interiors of said enclosures providing a maximum storage area;

a retractable closure upon one end of the telescoping enclosure;

said fixed enclosure including opposed side walls, a rear wall, and a top wall, said telescoping enclosure including opposed side walls and a top wall;

the mounting of said telescoping enclosure upon said fixed enclosure including a pair of elongated guide channels mounted upon and along the side walls of said fixed enclosure adjacent its top wall;

a first pair of opposed guide rollers within the rear end of said telescoping enclosure upon its opposite side walls adjacent its top wall, guidably supported within said channels; and a second pair of opposed rollers journaled within the front end of said telescoping enclosure upon its sidewalls at their lower edges supportably bearing against said ground surface.

2. In the collapsible shed of claim 1, further comprising:

the anchoring of the fixed enclosure including apertured inturned mount flanges extending along the lower edges of said rear and side walls; and fasteners extending through said flanges and into the ground surface.

3. In the collapsible shed of claim 1, further comprising:

a continuous trim seal of a flexible material having a free edge mounted over and along the trailing edges of said side and top walls of said telescoping enclosure and secured thereto; and a flexible seal extending along the free edge of said trim seal and in sliding engagement with the corresponding walls of the fixed enclosure.

4. In the collapsible shed of claim 1, further comprising:

said retractable closure including a spring-biased roller at its ends mounted upon the open end of said telescoping enclosure at its top;

a strip of flexible material anchored to and rolled upon said roller, and when unrolled and lowered closing off said telescoping enclosure; and an anchor means connected to said closure for securing the closure in its lowermost position.

5. In the collapsible shed of claim 1, further comprising a stop flange at the outer edge of said guide channels for limiting outward movement of said first pair of rollers and for limiting outward movement of said telescoping enclosure.

6. In the collapsible shed of claim 5, further comprising roller detent means upon said guide channels spaced from said stop flanges normally obstructing the return and closing movement of said first pair of rollers, sufficient additional force being applied to said telescoping enclosure to move said first pair of rollers over said detent means.

7. In the collapsible shed of claim 1, further comprising a pair of retractable auxiliary wheels pivotally supported upon the interior of the side walls of said fixed enclosure adjacent said open front, and adapted for pivotal lowering for supportive engagement with the ground surface below said side walls; and a trailer hitch attached to said rear wall extending therefrom to facilitate transport of said shed when disconnected from the ground surface.

8. In the collapsible shed of claim 1, further comprising the side walls of the fixed and telescoping enclosures being of uniform height and length.

* * * * *